US007364154B2

(12) United States Patent
Ichikawa et al.

(10) Patent No.: US 7,364,154 B2
(45) Date of Patent: Apr. 29, 2008

(54) SHEET FEEDING DEVICE

(75) Inventors: Takeshi Ichikawa, Nagano-ken (JP); Toru Tanjo, Nagano-ken (JP); Kazunori Koido, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 11/334,800

(22) Filed: Jan. 18, 2006

(65) Prior Publication Data

US 2006/0180997 A1 Aug. 17, 2006

(30) Foreign Application Priority Data

Jan. 18, 2005 (JP) ..... 2005-009937
Apr. 19, 2005 (JP) ..... 2005-120454
Apr. 19, 2005 (JP) ..... 2005-120455

(51) Int. Cl.
*B65H 1/00* (2006.01)

(52) U.S. Cl. ..... 271/162; 271/170

(58) Field of Classification Search ..... 271/170, 271/162, 164, 169, 109, 9.11
See application file for complete search history.

(56) References Cited

U.S. PATENT DOCUMENTS 4,394,009 A 7/1983 Bergman et al.
5,975,517 A 11/1999 Lim

FOREIGN PATENT DOCUMENTS

| | | |
|---|---|---|
| JP | 04-049128 | 2/1992 |
| JP | 06-009079 | 1/1994 |
| JP | 06-298380 | 10/1994 |
| JP | 06-329270 | 11/1994 |
| JP | 07-053065 | 2/1995 |
| JP | 08-231060 | 9/1996 |
| JP | 2003-171023 | 6/2003 |

*Primary Examiner*—David H Bollinger
(74) *Attorney, Agent, or Firm*—Hogan & Hartson LLP

(57) ABSTRACT

A sheet feeding device is operable to feed a sheet medium to an image forming apparatus. A cassette chamber has an inner face. A cassette member is adapted to accommodate the sheet medium therein, and to be withdrawably inserted into the cassette chamber in a first direction. The cassette member has an outer face adapted to oppose the inner face of the cassette chamber when the cassette member is inserted into the cassette chamber. At least one recess is formed on one of the inner face of the cassette chamber and the outer face of the cassette member. At least one protrusion is formed on the other one of the inner face of the cassette chamber and the outer face of the cassette member, and adapted to be fitted with the recess when the cassette member is plenarily inserted into the cassette chamber.

7 Claims, 12 Drawing Sheets

FIG. 3A
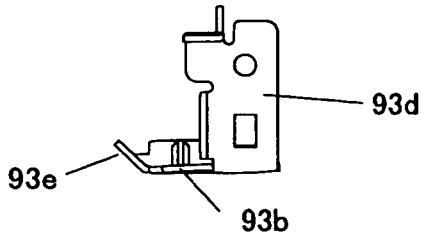
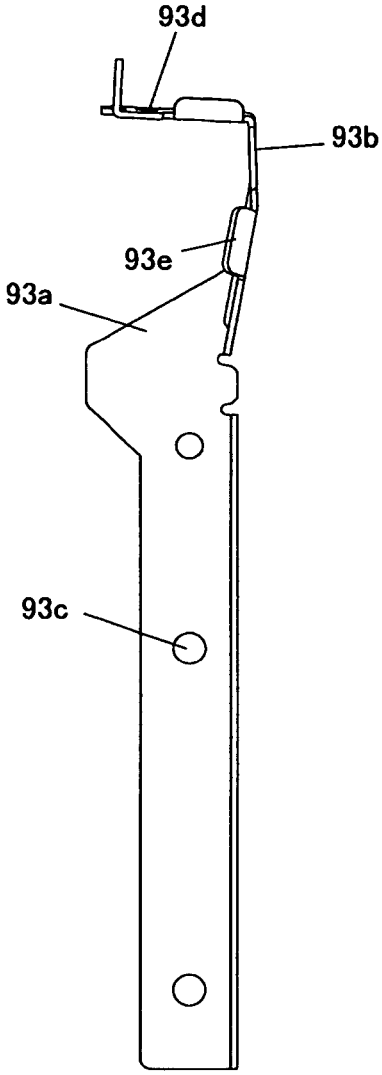
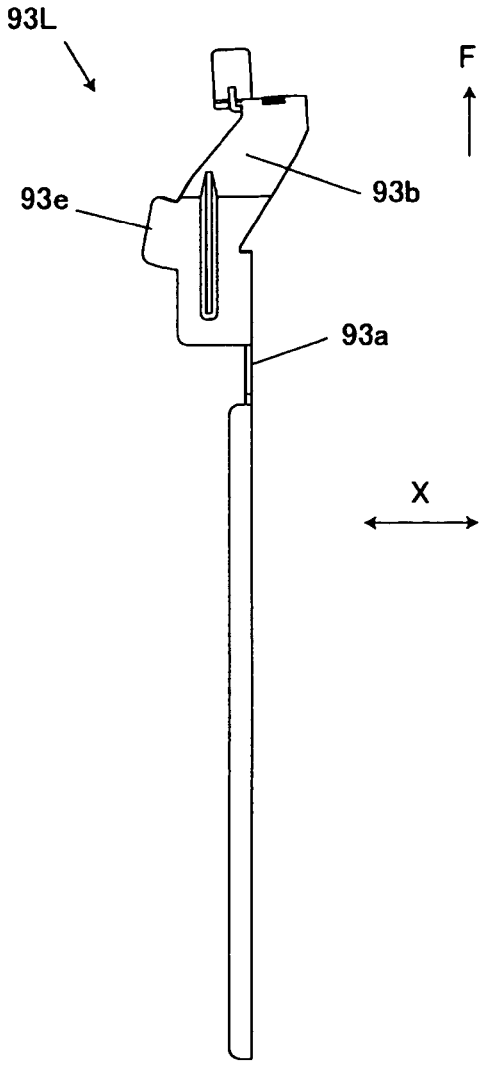
FIG. 3B
FIG. 3C

FIG. 4A
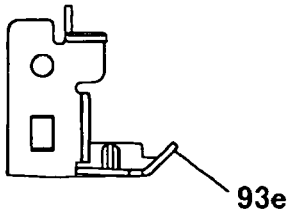
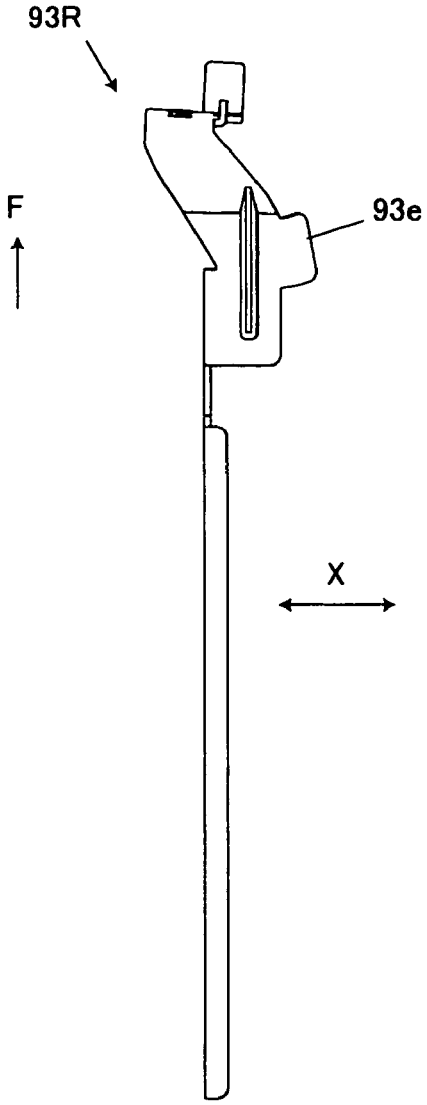
FIG. 4B
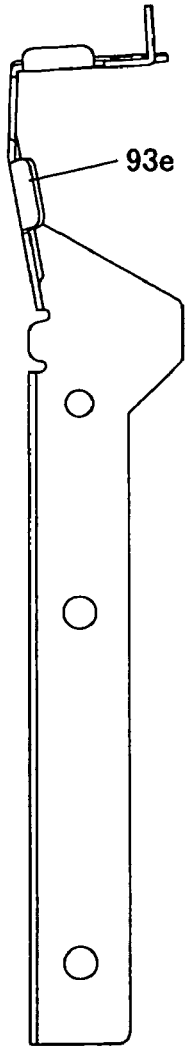
FIG. 4C

SHEET FEEDING DEVICE

BACKGROUND OF THE INVENTION

The present invention relates to a sheet feeding device incorporated in an image forming apparatus such as a printer, a facsimile machine, and a copying machine.

Japanese Patent Publication No. 6-9079A discloses a sheet feeding device that comprises: a sheet feeding roller having a semicircular cross section; a cassette body for accommodating, in a stacked state, sheet media to be fed by the sheet feeding roller; and a pair of separating claws that are provided in the cassette body and arranged such as to cover, from the above, leading edge corner parts of the stacked sheet media relative to a sheet feeding direction, thereby separating the sheet media into each sheet to be fed by the sheet feeding roller. The cassette body is withdrawably inserted into the device main body in the same direction as the sheet feeding direction.

A sheet feeding device employing such a sheet feeding roller is constructed such as to stop at the time of operation stop (at the time of non-feeding) in such a manner that the flat portion of the semicircular cross section opposes the sheet medium in the cassette body. Normally, insertion and withdrawal operation for the cassette body is performed in this state.

Nevertheless, by any reason (for example, when paper jam occurs, or when the power is deactivated by a user during the feeding operation), an abnormal state can arise that the sheet feeding roller stops in a state that an arcuate portion of the semicircular cross section faces the sheet medium in the cassette body. Under this abnormal condition, the user withdraws and inserts the cassette body in some cases.

In the above configuration that the cassette body is inserted in the same direction as the sheet feeding direction of the sheet medium, even when the cassette body has been withdrawn or inserted by the user at the time of abnormity described above, the separating claws provided in the cassette body have been prevented from colliding with the sheet feeding roller.

Nevertheless, in a sheet feeding device, in some cases, the cassette body is desired to be constructed such that the cassette body is withdrawably inserted into the device main body in a direction perpendicular to the sheet feeding direction of the sheet medium. In this configuration, when the cassette body is withdrawn or inserted by the user at the time of abnormity described above, the separating claw located in the back part relative to the insertion and withdrawal direction of the cassette body would collide with the semicircular sheet feeding roller, so that deformation or damage would arise in the separating claw. As a result, appropriate separation operation for the sheet media cannot be performed.

The back face of the cassette body relative to the insertion and withdrawal direction thereof is made flat as disclosed in Japanese Patent Publication No. 6-329270A.

Even when a sheet medium remains in the device main body (simply referred to as a main body, hereinafter in some cases) at the time of cassette withdrawal by any reason, a user would be unaware of the situation in some cases, and hence insert the cassette body again so as to use the sheet feeding device.

In such a case, the sheet medium that remains in the main body (referred to as a remained sheet medium, hereinafter in some cases) may stay in a state pinched and squashed between the cassette back face and a face of the main body opposite to the cassette back face. This causes a problem that a part of the remained sheet medium comes in contact with a sheet medium fed from the cassette, thereby causes resistance to the fed sheet medium, and thereby prevents the fed sheet medium from being transported appropriately, so that feeding failure or skew feeding arises.

There is known a feeding device in which plural stages of cassette bodies are provided. Between these cassette bodies and the device main body, a locking mechanism is provided for locking into a mounted state when the cassette bodies are mounted on the device main body.

In the above sheet feeding device, the locking mechanism between the cassette body and the device main body has the same configuration for every stage.

On the other hand, in a sheet feeding device comprising plural stages of cassette bodies, when a user withdraws (pulls out) a cassette body, in general, withdrawal angles for the plural stages of cassette bodies differ from each other for these stages. In general, a cassette body is withdrawn in such a manner that the handle of the cassette body is somewhat lifted up. This causes a difference between the withdrawal angle for the cassette body of lower stage and the withdrawal angle for the cassette body of upper stage.

Thus, when the locking mechanism has the same configuration for every stage as described the above, the user feels a difference between the withdrawal force at the time of withdrawing the cassette body of lower stage and the withdrawal force at the time of withdrawing the cassette body of upper stage, and hence acquires a feeling that something is wrong.

SUMMARY OF THE INVENTION

It is therefore a first object of the invention to provide a sheet feeding device in which the deformation or breakage of a separating claw and a sheet feeding roller can be avoided even when it is constructed that a cassette body is withdrawably inserted in to a device main body in a direction perpendicular to a feeding direction of a sheet medium.

It is therefore a second object of the invention to provide a sheet feeding device in which a cassette body cannot appropriately be mounted on a device main body when a sheet medium remains in the device main body at the time of cassette withdrawal by any reason.

It is therefore a third object of the invention to provide a sheet feeding device that does not cause (at least reduces) a feeling that something is wrong when a user withdraws cassette bodies of different stages.

In order to achieve the first object, according to the invention, there is provided a sheet feeding device, comprising:

- a cassette chamber, having a slot;
- a cassette member, adapted to accommodate a sheet medium therein, and to be withdrawably inserted into the cassette chamber through the slot in a first direction;
- a pair of claw members, provided in the cassette member and adapted to cover at least a part of a top face of the sheet medium;
- a sheet feeding roller, adapted to feed the sheet medium to an image forming apparatus in a second direction perpendicular to the first direction, and disposed such that a part of the sheet feeding roller is capable of entering the cassette chamber; and
- slope faces, formed on both sides of the part of the sheet feeding roller relative to the first direction, and inclined in a third direction orthogonal to the first direction and the second direction.

With this configuration, at the time of insertion or withdrawal of the cassette member, even when the claw members come in contact with the part of the sheet feeding roller, the claw members smoothly pass through beneath the sheet feeding roller along the slope faces of the sheet feeding roller. This avoids deformation or breakage in the claw members and the sheet feeding roller, and hence maintains appropriate feeding operation.

One of the claw members which is located farther from the slot may be formed with a piece member extending in the first direction while being inclined in the third direction.

In this case, the claw member is guided by the piece member and thereby much more smoothly passes through beneath the sheet feeding roller along the slope faces of the sheet feeding roller. Therefore, appropriate sheet feeding operation can be maintained more reliably.

Here, one of the claw members which is closer to the slot may be formed with a piece member extending in a fourth direction opposite to the first direction while being inclined in the third direction.

In this case, when the sheet medium is fed, the exerted forces from the pair of claw members acting on the sheet medium become the same. This realizes better sheet feeding operation.

In order to achieve the second object, according to the invention, there is provided a sheet feeding device, operable to feed a sheet medium to an image forming apparatus, comprising:

a cassette chamber, having an inner face;

a cassette member, adapted to accommodate the sheet medium therein, and to be withdrawably inserted into the cassette chamber in a first direction, the cassette member having an outer face adapted to oppose the inner face of the cassette chamber when the cassette member is inserted into the cassette chamber;

at least one recess, formed on one of the inner face of the cassette chamber and the outer face of the cassette member; and at least one protrusion, formed on the other one of the inner face of the cassette chamber and the outer face of the cassette member, and adapted to be fitted with the recess when the cassette member is plenarily inserted into the cassette chamber.

With this configuration, in a case that a sheet medium remains in the sheet feeding device at the time of cassette withdrawal by any reason, when the cassette member is re-inserted after that, the remained sheet medium intervenes between the recess and protrusion, and thereby prevents the recess and protrusion from fitting with each other. As a result, the cassette member cannot be fully inserted into the cassette chamber. Thus, the user becomes aware of the abnormity, and hence removes the remained sheet medium. Accordingly, such a situation is avoided that the sheet feeding device is used in a state that a remained sheet medium stays therein. This avoids the occurrence of feeding failure and skew feeding.

A plurality of recesses and protrusions may be arrayed in a second direction perpendicular to the first direction. Here, the sheet medium may be fed in the second direction.

In this case, when a remained sheet medium is present, regardless of its position, almost at all positions, the recesses and protrusions are prevented from fitting in with each other. This avoids more reliably the situation that the sheet feeding device is used in a state that a remained sheet medium stays therein.

In order to achieve the third object of the invention, there is also provided a sheet feeding device, adapted to feed a sheet medium to an image forming apparatus, comprising:

a first cassette chamber, formed with a first recess;

a second cassette chamber, located above the first cassette chamber, the second cassette chamber formed with a second recess;

a first cassette member, adapted to accommodate the sheet medium therein, and to be withdrawably inserted into the first cassette chamber in a first direction;

a second cassette member, adapted to accommodate the sheet medium therein, and to be withdrawably inserted into the second cassette chamber in the first direction;

a first protrusion, formed on the first cassette member and adapted to be engaged with the first recess with a first engagement strength, when the first cassette member is inserted into the first cassette chamber; and a second protrusion, formed on the second cassette member and adapted to be engaged with the second recess with a second engagement strength which is smaller than the first engagement strength, when the second cassette member is inserted into the second cassette chamber.

With this configuration, the withdrawal force necessary when the user withdraws the cassette member of lower stage becomes the same as (at least approaches) the withdrawal force necessary when the user withdraws the cassette member of upper stage. Thus, a feeling that something is wrong is avoided (at least reduced) when the user withdraws cassette members of different stages.

The first protrusion and the second protrusion may have an identical shape including a first face. The first recess may have a second face adapted to oppose the first face of the first protrusion in the first direction and inclined with a first angle relative to the first direction. The second recess may have a third face adapted to oppose the first face of the second protrusion in the first direction and inclined with a second angle which is smaller than the first angle relative to the first direction.

BRIEF DESCRIPTION OF THE DRAWINGS

The above objects and advantages of the present invention will become more apparent by describing in detail preferred exemplary embodiments thereof with reference to the accompanying drawings, wherein:

FIG. 3A is a rear view of the left separating claw in the cassette body;

FIG. 3B is an outer side view of the left separating claw;

FIG. 3C is a top view of a left separating claw in the cassette body;

FIG. 4A is a rear view of the right separating claw;

FIG. 4B is a top view of a right separating claw in the cassette body;

FIG. 4C is an outer side view of the right separating claw;

DETAILED DESCRIPTION OF THE EMBODIMENTS

Embodiments of the invention will be described below in detail with reference to the accompanying drawings.

Figure 1:
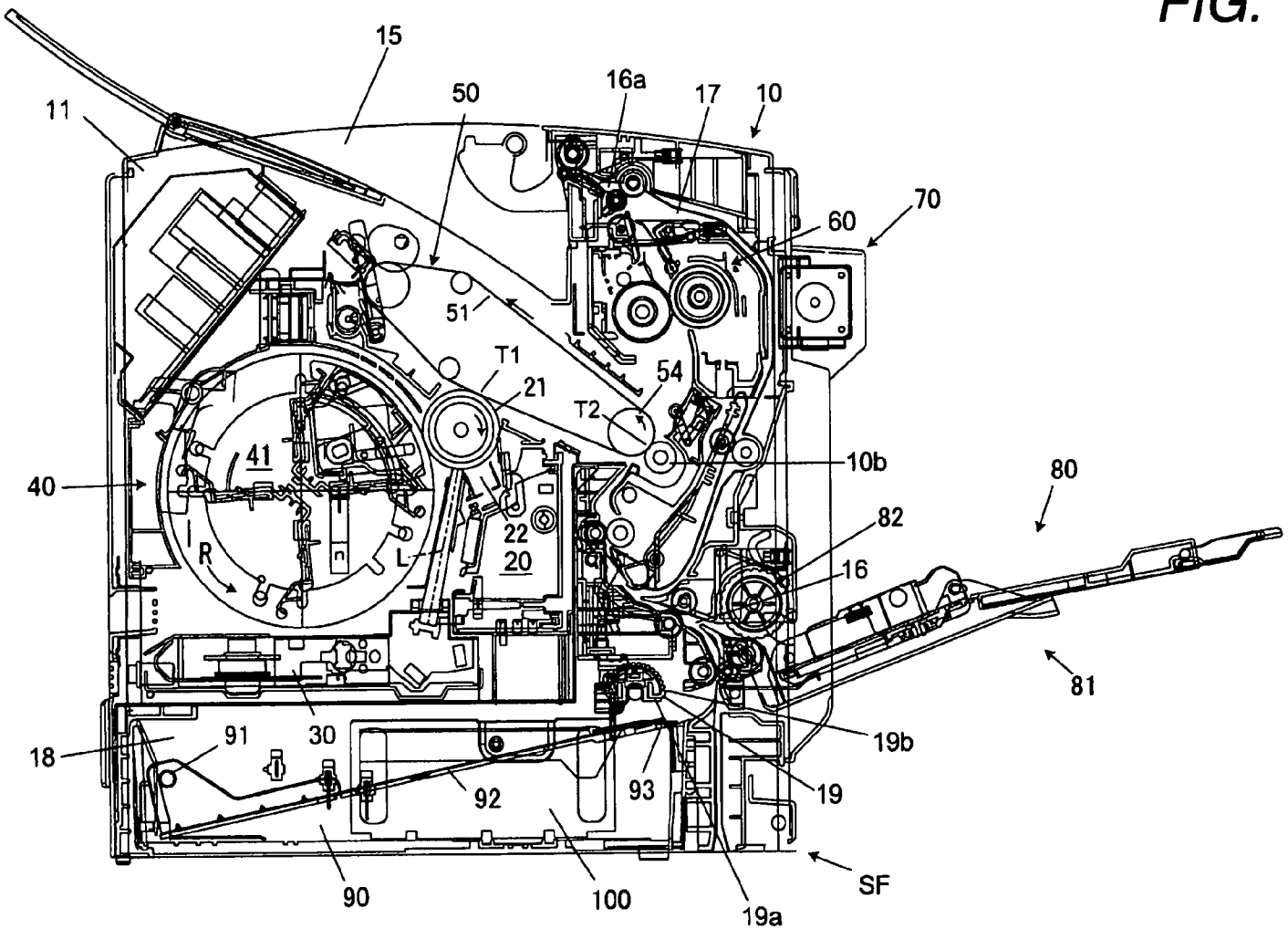
FIG. 1 is a section view of an image forming apparatus incorporating a sheet feeding device according to a first embodiment of the invention.

FIG. 1 shows an image forming apparatus incorporating a sheet feeding device according to a first embodiment of the invention.

This image forming apparatus is a color image forming apparatus for longitudinally feeding a sheet medium of A4 size (including the letter size) and capable of forming full color images on both sides. The image forming apparatus comprises: a casing body 11; an image carrier unit 20 accommodated in the casing body 11; an exposure unit 30; a developing unit 40; an intermediate transfer body unit 50; and a fuser unit 60.

In the casing body 11, a frame of an apparatus body 10 is provided but not shown. Then, various units and the like are attached to this frame.

The image carrier unit 20 comprises: a photosensitive body 21 having a photosensitive layer in its outer periphery face; and a corona electrostatic charger (scorotron electrostatic charger) 22 for electrostatically charging the outer periphery face of the photosensitive body 21 uniformly. Then, selective exposure with laser light L from the exposure unit 30 is performed on the uniformly charged outer periphery face of the photosensitive body 21, so that an electrostatic latent image is formed thereon. After that, toner serving as a developer agent is imparted to the electrostatic latent image in the developer 40, so that the image is converted into a visible image (toner image). This toner image is primarily transferred by a primary transfer section T1 onto an intermediate transfer belt 51 of the intermediate transfer body unit 50. After that, in a secondary transfer section T2, the image is secondarily transferred onto a sheet medium serving as a transfer target.

The inside of the casing body 11 is provided with: a conveyance path 16 along which a sheet medium having an image formed on one side by the above-mentioned secondary transfer section T2 is conveyed toward a sheet ejecting section (ejecting tray) 15 disposed in the upper face of the casing body 11; and a return path 17 along which the sheet medium conveyed toward the sheet ejecting section 15 along the conveyance path 16 is switched back and returned toward the secondary transfer section T2 in order that an image should be formed also on the other face.

Numeral 70 indicates a double-sided printing unit detachably provided in the apparatus main body 10. When this double-sided printing unit 70 is attached, the return path 17 is formed.

In a lower part of the casing body 11, a sheet feeding device SF is incorporated. The sheet feeding device SF is provided with a cassette body 18 for accommodating a plurality of sheet media in a stacked manner, and with a sheet feeding roller 19 for separately feeding each of the sheet media to the above-mentioned secondary transfer section T2. The sheet feeding roller 19 has a semicircular cross section. Detail of the sheet feeding device SF will be described later.

Under the above-mentioned double-sided printing unit 70, a tray 81 is provided that serves as a manual feeding section 80. A sheet feeding roller 82 for separately feeding each of sheet media placed on the tray 81 is provided in the apparatus main body 10.

The developing unit 40 comprises a rotary developing device, in which a plurality of developer cartridges (not shown) respectively containing yellow toner, cyan toner, magenta toner, and black toner are replaceably arranged in a rotor body 41. When the rotor body 41 rotates in a 90° pitch in the direction indicated by an arrow R, a developing roller (not shown) provided in each developer cartridge comes in contact with the photosensitive body 21 selectively. Thus, the face of the photosensitive body 21 can be developed selectively.

The exposure unit 30 emits the laser light L onto the photosensitive body 21.

The intermediate transfer body unit 50 comprises: a unit frame which is not shown; and the intermediate transfer belt 51 stretched by a driving roller 54 and a plurality of follower rollers supported rotatably in the frame. The intermediate transfer belt 51 is driven and circulated in the direction indicated by an arrow in the figure. A contacting part between the photosensitive body 21 and the intermediate transfer belt 51 forms the primary transfer section T1, while a pressure contacting part between the driving roller and the secondary transfer roller 10*b* forms the secondary transfer section T2.

The secondary transfer roller 10*b* is retractably brought into contact with a part of the intermediate transfer belt 51 wound around the driving roller 54 to form the secondary transfer section T2.

Thus, in the formation of a color image, plural colors of toner images are overlaid on the intermediate transfer belt 51 in a state that the secondary transfer roller 10*b* is separated from the intermediate transfer belt 51, so that a color image is formed. After that, the secondary transfer roller 10*b* contacts with the intermediate transfer belt 51, while a sheet medium is provided to the contacting part (secondary transfer section T2), so that the color image (toner image) is transferred from the intermediate transfer belt 51 onto the sheet medium.

The sheet medium onto which the toner image has been transferred passes through the fuser unit 60, so that fusion fixing of the toner image is performed. Then, the sheet medium is ejected toward the ejecting tray 15.

The feeding of a sheet medium to the image forming section is selectively performed from one of the sheet feeding device SF and the manual feed section 80 described above.

Ordinary, regular paper or the like are normally placed in the cassette body 18 of the sheet feeding device SF. In contrast, various types of sheet media are placed on the tray 81 depending on the necessity. That is, depending on the necessity of a user, regular paper, thick paper, postcards, envelopes, OHP sheets, or other recording media are appropriately placed on the tray 81.

Figure 2:
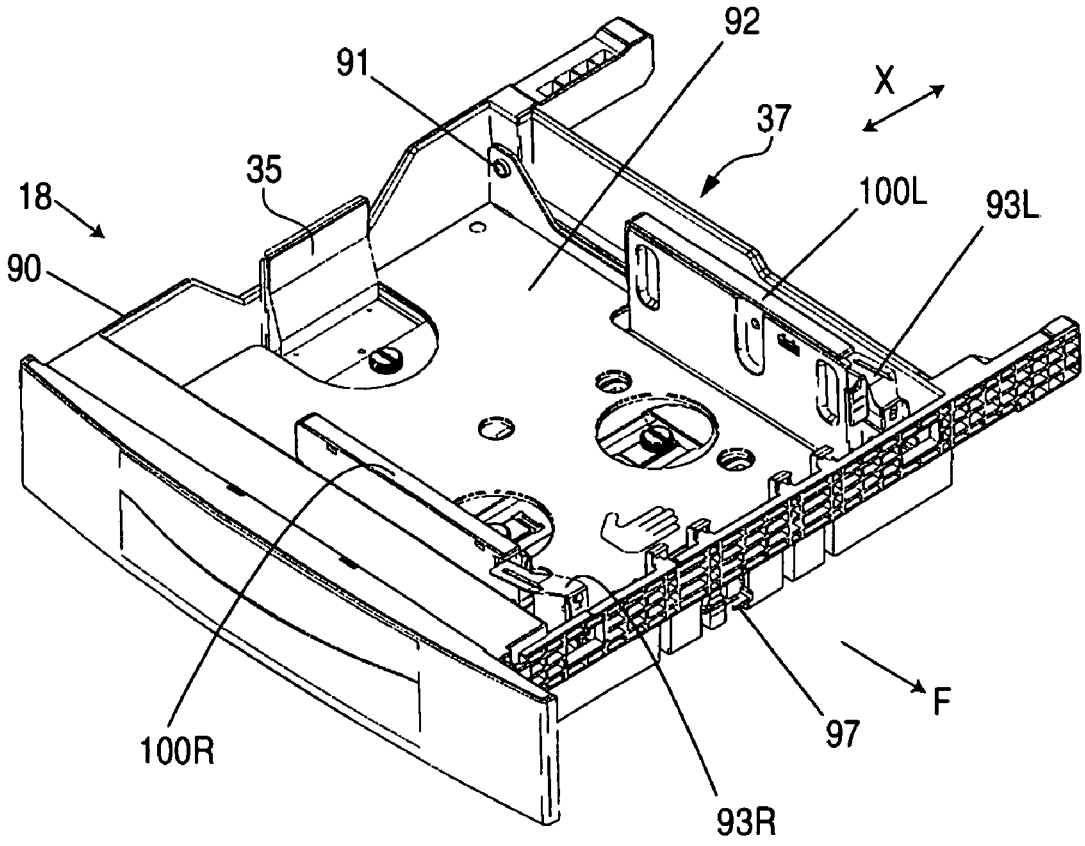
FIG. 2 is a perspective view of a cassette body to be incorporated in the sheet feeding device of FIG. 1.

As shown in FIG. 2, a pair of separating claws 93L and 93R are provided in the cassette body 18 and arranged such as to cover, from the above, leading edge corner parts of the stacked sheet media relative to a sheet feeding direction, thereby separating the sheet media into each sheet to be fed by the sheet feeding roller 19.

It is constructed that the cassette body 18 is withdrawably inserted into the device main body 10 in directions X perpendicular to the sheet feeding direction F.

As shown in FIGS. 1 and 2, the cassette body 18 comprises: a box-shaped main body 90; a positioning member 35 for regulating the trailing edge position of the stacked sheet media; a hopper plate 92 attached pivotably about shafts 91 provided in the main body 90; and the separating claws 93L and 93R. A coil spring (not shown) is provided between the hopper plate 92 and the bottom part of the main body 90. This coil spring pushes up the hopper plate 92 so that the sheet media are pressed against the sheet feeding roller 19. The separating claws 93L and 93R are pushed up by the hopper plate 92, thereby engage with the two corner parts of the leading edge of the uppermost sheet medium (not shown) fed by the sheet feeding roller 19. The two corner parts of the uppermost sheet medium is bent so that the uppermost sheet medium is separated from the next sheet medium.

As shown in FIGS. 3A through 4C, the separating claws 93L and 93R are constructed symmetrically (in an identical shape). Thus, the following description is given with using the separating claw 93R as a representative and with reference to FIGS. 4A to 4C, unless otherwise necessary. The representative separating claw is denoted by numeral 93 (see FIG. 1).

Figure 5A:
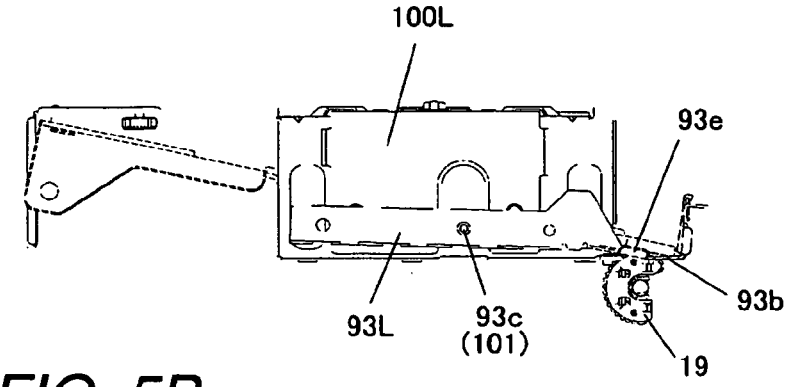
FIG. 5A is a left side view of the sheet feeding device.
Figure 5B:
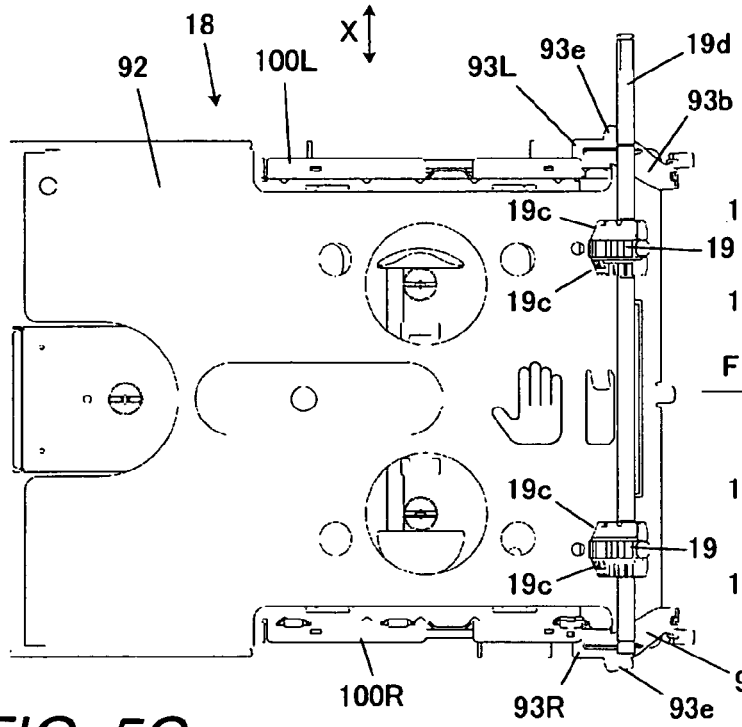
FIG. 5B is a top plan view of the sheet feeding device.
Figure 5D:
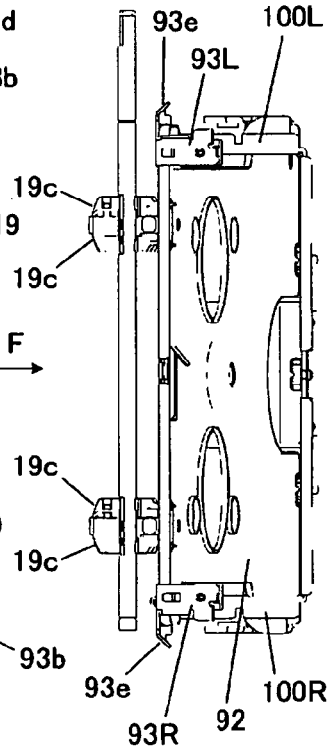
FIG. 5D is a rear view of the sheet feeding device.
Figure 5C:
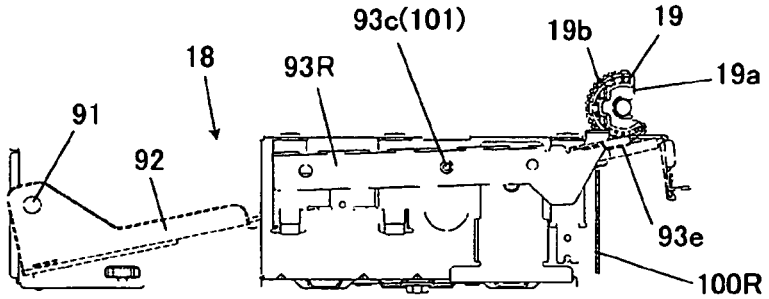
FIG. 5C is a right side view of the sheet feeding device.

The separating claw 93 is fabricated from sheet metal, and comprises a vertical part 93*a*, a horizontal part 93*b*, and a rear plate part 93*d*. The horizontal part 93*b* hangs the corner part of the sheet medium from the above (see FIG. 5A). A hole 93*c* is provided approximately in the center of the vertical part 93*a*. Through the hole 93*c*, the separating claw 93 is attached rotatably about a pin 101 (see FIGS. 5B and 5C) of the side guide unit 100R or 100L for guiding the side edge of the sheet media.

In this embodiment, when the feeding operation is not performed, the sheet feeding roller 19 stops in a state that the flat portion 19*a* of the semicircular cross section faces but does not come in contact with the sheet medium in the cassette body 18 as shown in FIG. 1. Normally, insertion and withdrawal operation for the cassette body 18 is performed in this state.

Nevertheless, by any reason (for example, when paper jam occurs, or when the power is deactivated by a user during the feeding operation), the sheet feeding roller 19 may stop in a state that the arcuate portion 19*b* of the semicircular cross section faces the sheet medium in the cassette body 18 as shown in FIGS. 5A to 5D.

Under this abnormal condition, if no countermeasure were employed, when the cassette body 18 is inserted or withdrawn by the user in the direction indicated by an arrow X, the separating claw 93L located in the back section relative to the insertion and withdrawal direction of the cassette body 18 collides with the side face (vertical face) of the sheet feeding roller 19, so that deformation or damage arises in the separating claw 93L and thereby appropriate separation operation for the sheet media is hindered.

Thus, in this embodiment, as shown in FIGS. 5A to 5D, both side faces of the sheet feeding roller 19 are formed with a slope face 19*c*. In these figures, numeral 19*d* indicates a driving shaft of the sheet feeding roller 19. Although the slope face 19*c* extends linearly, it may extends while being curved. The slope face 19*c* is formed over the entire region where the separating claw 93L would come contact with the sheet feeding roller 19 when the cassette 18 is withdrawn or inserted under the above-mentioned abnormal condition.

Further, among the pair of separating claws, at least on the rear side (the left-hand side in FIG. 3C) of the separating claw 93L located in the rear section relative to the insertion and withdrawal direction of the cassette body 18, a tongue piece 93*e* is formed integrally that has downward inclination toward the rear side. The tongue piece 93*e* is formed over the entire region where the separating claw 93L would come in contact with the sheet feeding roller 19 when the cassette body 18 is inserted under the above-mentioned abnormal condition.

On the other hand, on the front side (the right-hand side in FIG. 4B) of the separating claw 93R located on the front section relative to the insertion and withdrawal direction of the cassette body 18, a tongue piece 93*e* is formed integrally that has the same shape as the above-mentioned tongue piece and downward inclination toward the front side. As a result, a pair of separating claws 93L and 93R are constructed symmetrically.

Figure 6A:
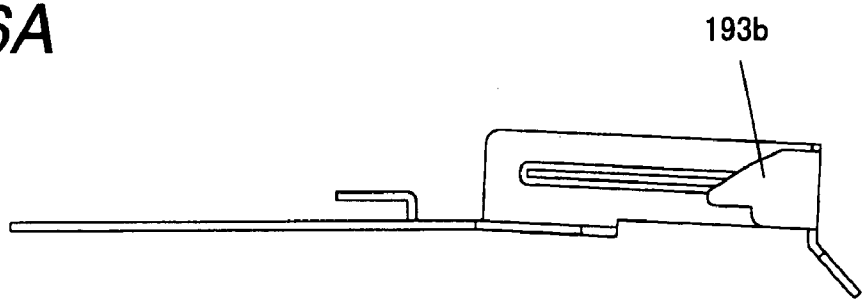
FIG. 6A is a top plan view of a comparative separating claw.
Figure 6B:
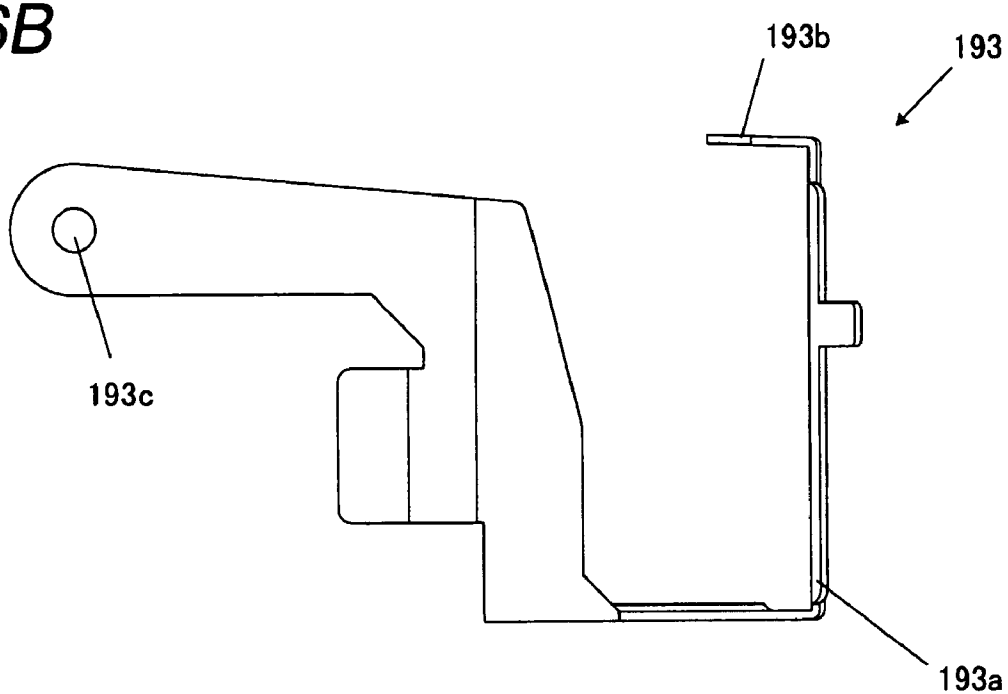
FIG. 6B is a side view of the comparative separating claw.
Figure 6C:
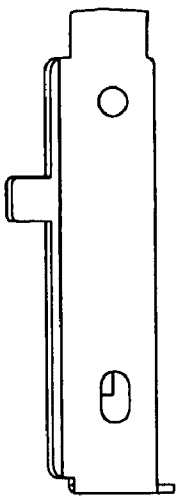
FIG. 6C is a rear view of the comparative separating claw.

FIGS. 6A to 6C show a separating claw 193 having a different configuration as a comparative example. In this example, an arm part 193*a* formed with a hole 193*c* serving as a pivot center is bent so as to form a hook portion 193*b* extending forward. The hook portion 193*b* is adapted to hang over the leading edge corner part of the stacked sheet media.

With this configuration, the above-mentioned collision between the sheet feeding roller 19 and the separating claw 193 can be avoided at the time of cassette insertion and withdrawal. Nevertheless, since the arm part 193*a* is once extended downward and is then extended upward, an increase is caused in the total length of the arm part 193*a* itself that extends from the pivot center 193*c* to the hook portion 193*b*. This degrades the positional accuracy of the hook portion 193*b*, and hence causes a difficulty to achieve good separating operation for the sheet media.

Thus, in this embodiment, the vertical part 93*a* corresponding to the arm part 193*a* extends almost linearly from the pivot center 93*c* to the horizontal part 93*b* that covers, from the above, the leading edge corner part of the stacked sheet media (corresponding to the hook portion 193*b*).

According to the above-described configuration, at the time of insertion or withdrawal of the cassette body 18, even when the separating claw 93 comes in contact with the sheet feeding roller 19 placed in the abnormal position, the separating claw is guided along the slope face 19*c* of the sheet feeding roller 19, and thereby smoothly passes through beneath the sheet feeding roller 19. This avoids deformation or breakage in the separating claw 93, and hence maintains appropriate separating operation for the sheet media.

Further, the tongue piece 93*e* configured as described the above assists the smooth passage of the separating claw 93 beneath the sheet feeding roller 19.

Figure 7A:
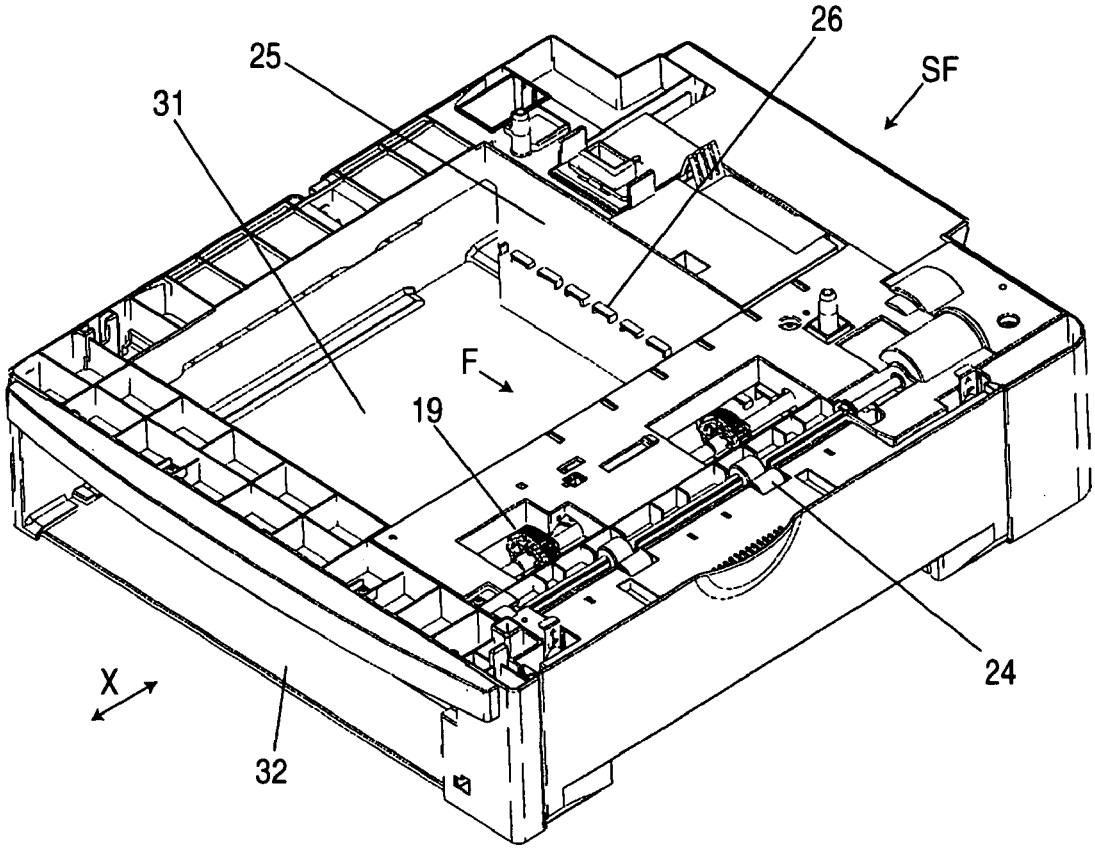
FIG. 7A is a perspective view of the sheet feeding device, showing a state that the cassette body is removed.
Figure 7B:
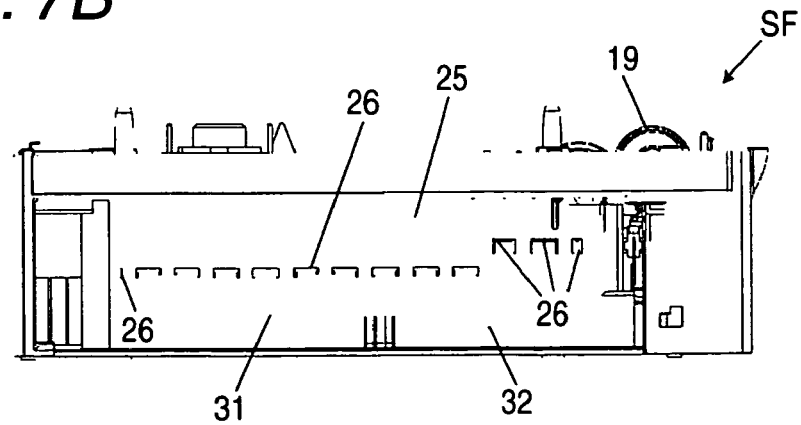
FIG. 7B is a front view showing the state of FIG. 7A.

As shown in FIGS. 7A and 7B, the sheet feeding device SF comprises: a cassette chamber 31; a slot 32 through which the cassette body 18 is withdrawably inserted into the cassette chamber 31; the sheet feeding roller 19; and a conveying roller pair 24 for conveying to the image forming apparatus main body the sheet medium fed by the sheet feeding roller 19.

Figure 8A:
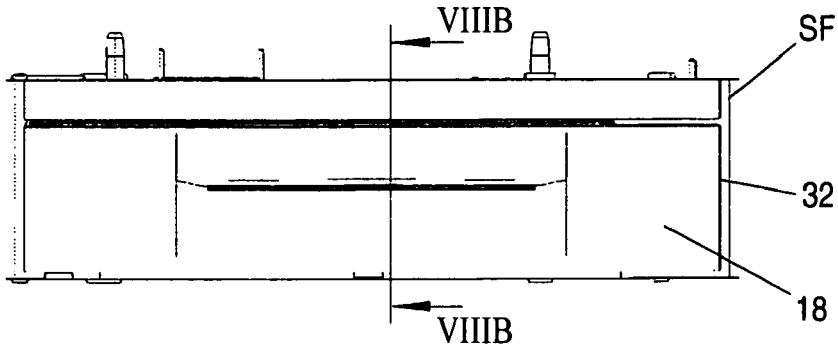
FIG. 8A is a front view of the sheet feeding device, showing a state that the cassette body is mounted.
Figure 8B:
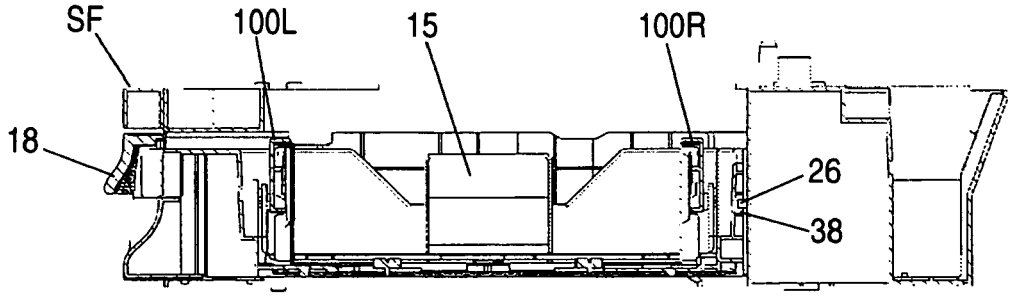
FIG. 8B is a section view of the sheet feeding device, showing the state of FIG. 8A.
Figure 8C:
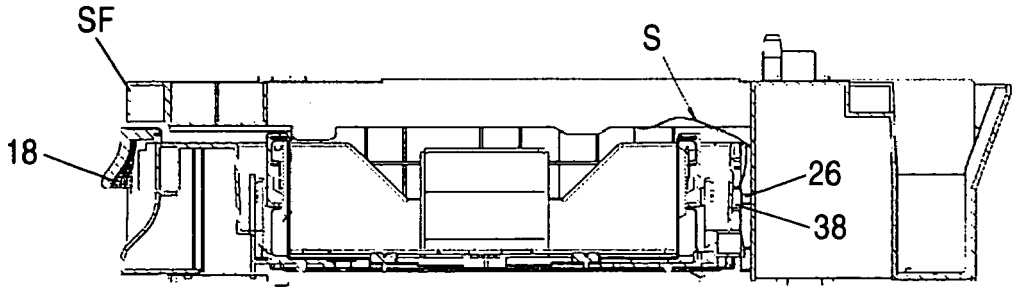
FIG. 8C is a section view of the sheet feeding device, showing a state that the cassette body is prevented from being mounted.

In this embodiment, a back (rear) face 37 of the cassette body 18 relative to the insertion and withdrawal direction X and a face 25 of the sheet feeding device SF opposing to the back face 37 are provided respectively with a recess and a protrusion which fit with each other when the cassette body 18 is mounted on the sheet feeding device SF as shown in FIGS. 8A and 8B.

Figure 9A:
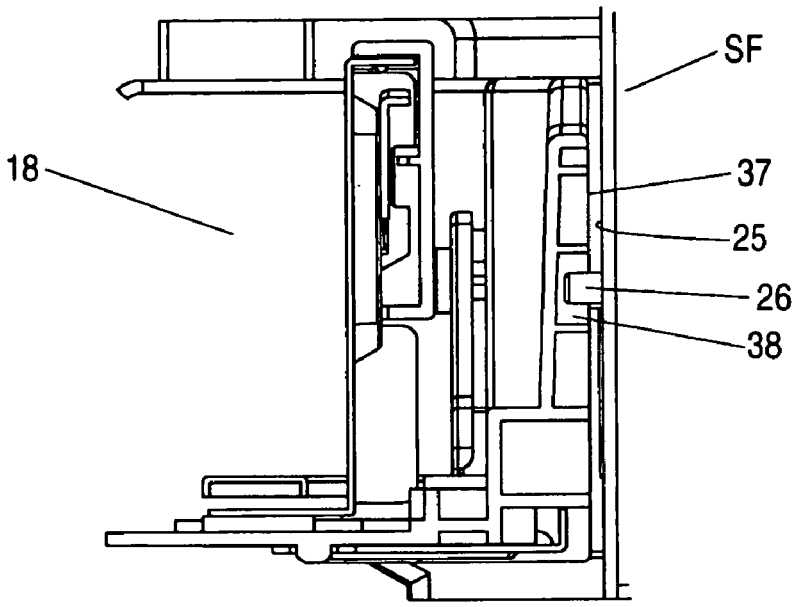
FIG. 9A is an enlarged view showing the state of FIG. 8B.

More specifically, as shown in FIGS. 7A, 7B and 9A, a protrusion 26 is provided in the above-mentioned opposite face 25 of the sheet feeding device SF. Then, at a position opposing the protrusion 26, as shown in FIG. 9A, a recess 38 into which the protrusion 26 is inserted (loosely fit) is provided in the back face 37 of the cassette body 18.

A plurality of these protrusions 26 and recesses 38 are provided along approximately the entire length of the sheet medium length in the direction F perpendicular to the insertion and withdrawal direction X of the cassette body 18 (a series of protrusions 26 are solely shown in FIGS. 7A and 7B). In this embodiment, 13 pairs of the protrusions 26 and the recesses 38 are provided.

Figure 9B:
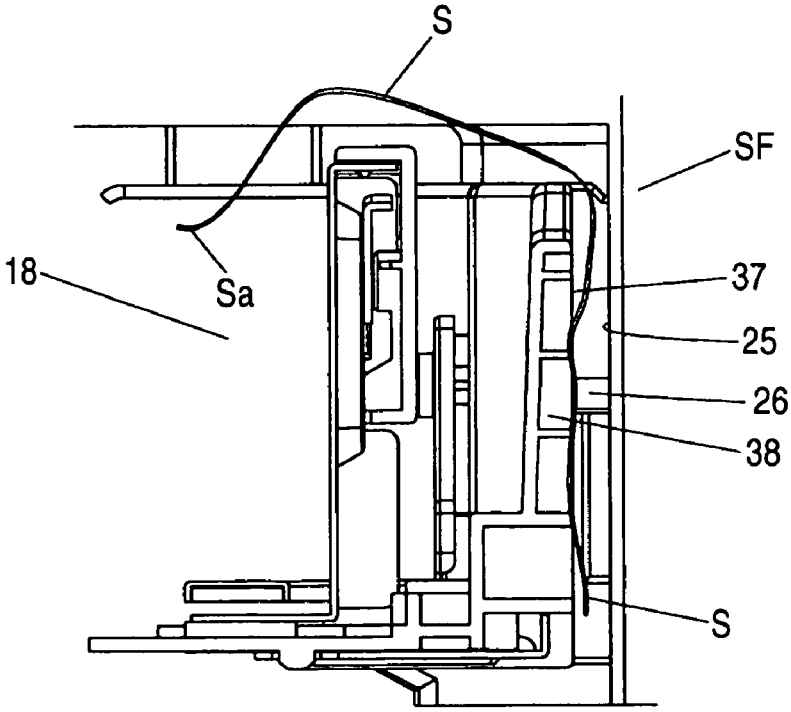
FIG. 9B is an enlarged view showing the state of FIG. 8C.

According to this configuration, in a case that a sheet medium remains in the main body at the time of cassette withdrawal by any reason, when the cassette 10 is re-inserted after that, as shown in FIG. 9B, the remained sheet medium S intervenes between the recesses 38 and the protrusions 26 described above, and thereby prevents the recesses 38 and the protrusions 26 from fitting in with each other. As a result, the cassette 10 cannot appropriately be set into the sheet feeding device SF. Thus, the user becomes aware of the abnormity, and hence removes the remained sheet medium S.

Alternatively, the sheet feeding device SF may be provided with a detector for detecting that the cassette body 18 is mounted appropriately, so that when the cassette body 18 is not appropriately mounted, an indicator (not shown) may indicate the abnormity and thereby warning the user.

In a state that the remained sheet medium S stays, if the user were unaware of the situation and inserted the cassette again so as to use the sheet feeding device, a part Sa of the remained sheet medium S (see FIG. 9B) may contact a sheet medium duly fed from the cassette, and thereby cause resistance to the fed sheet medium. Thus, the fed sheet medium would not appropriately be transported, so that feeding failure and skew feeding would arise. However, the above configuration can avoid such a situation.

Further, a plurality of the recesses and protrusions are provided along approximately the entire length of the sheet medium in a direction perpendicular to the insertion and withdrawal direction of the cassette body 18. Thus, when a remained sheet medium S is present, regardless of its position, almost at all positions, the recesses 38 and protrusions 26 are prevented from fitting in with each other. This avoids more reliably the situation that the sheet feeding device SF is used in a state that a remained sheet medium S stays therein.

Figure 10B:
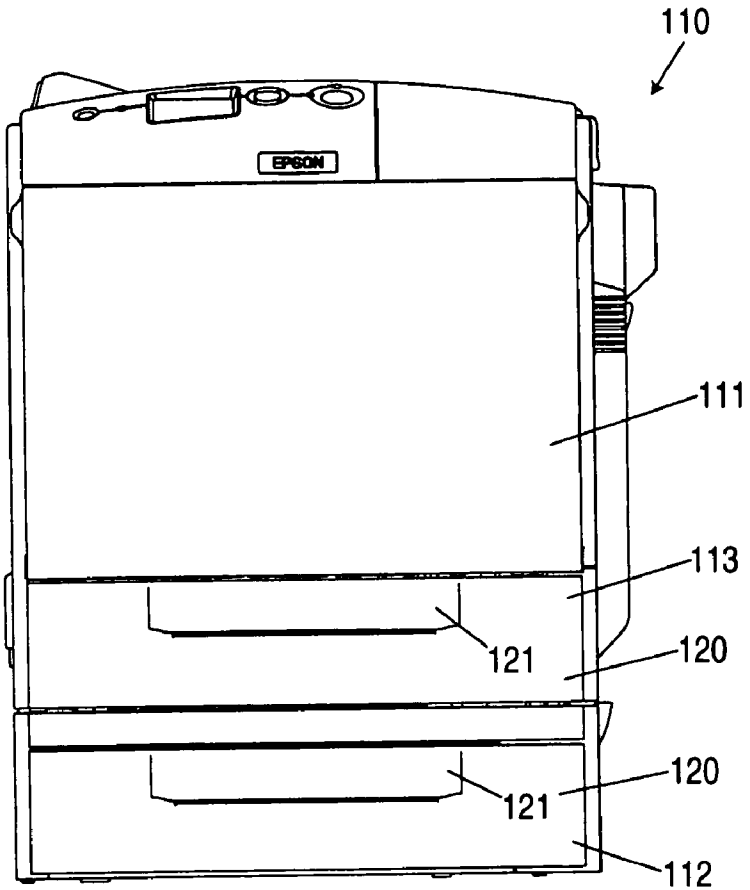
FIG. 10B is a front view of the image forming apparatus of FIG. 10A.
Figure 10A:
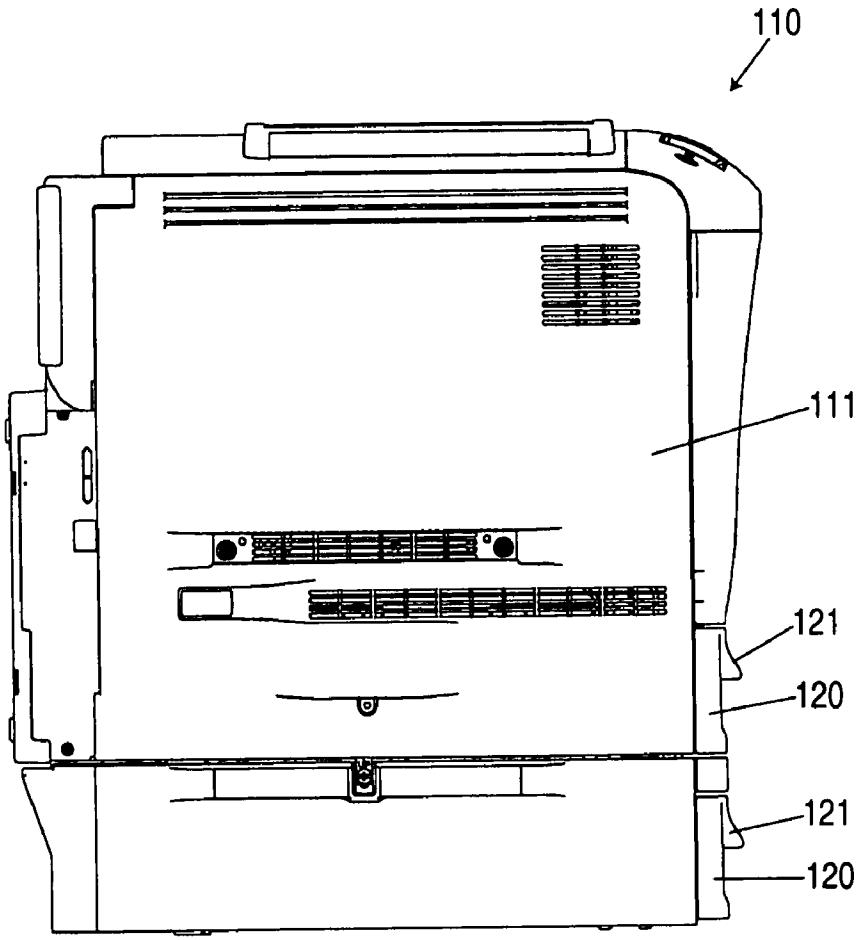
FIG. 10A is a side view of an image forming apparatus incorporating sheet feeding devices according to a second embodiment of the invention.

Next, an image forming apparatus 110 according to a second embodiment of the invention will be described. As shown in FIGS. 10A and 10B, a sheet feeding mechanism (not shown) is incorporated into this image forming apparatus 110. Thus, a casing body 111 of the image forming apparatus 110 constitutes a casing body 111 of the sheet feeding device.

It is constructed that each of cassette bodies 120 is withdrawably inserted into cassette chambers 112 and 113 formed in the casing body 11. In this embodiment, two stages of cassette bodies 120 having an identical shape are provided in the vertical direction. However, three or more stages may be provided. The cassette body 120 accommodates, in a stacked state, sheet media each of which is separately fed to the image forming apparatus 110.

A handle 121 is provided in the front face of the cassette body 120. With hanging fingers on the handle 121, a user can withdraw the cassette body 120 from the casing body 111, and can insert the cassette body 120 in the chambers 112 and 113 of the casing body 111.

As shown in FIGS. 11A through 12B, locking mechanisms L1 and L2 are provided respectively between the chambers 112 and 113 of the casing body 111 and the cassette bodies 120.

The locking mechanism L1 of lower stage comprises: a recess 112*b* provided in a bottom wall 112*a* of the cassette chamber 112; and a protrusion 123 provided in a bottom part 122 of the cassette body 120 and adapted to be engaged with the recess 112*b*.

The locking mechanism L2 of upper stage comprises: a recess 113*b* provided in a bottom wall 113*a* of the cassette chamber 113; and a protrusion 123 provided in a bottom part 122 of the cassette body 120 and adapted to be engaged with the recess 113*b*.

When the cassette body 120 is inserted into the cassette chamber 112 of lower stage, the protrusion 123 of the cassette body 120 engages with the recess 112*b*, and thereby prevents unintentional withdrawal of the cassette body 120. When the cassette body 120 is inserted into the cassette chamber 113 of upper stage, the protrusion 123 of the cassette body 120 engages with the recess 113*b*, and thereby prevents unintentional withdrawal of the cassette body 120.

Further, in each of the cassette bodies 120 of lower stage and upper stage, when fingers are hung on the handle 121 so that a force is applied in the direction of withdrawal, the engagement between the protrusion 123 and the recess is released so that the cassette body 120 can be withdrawn.

Figure 12A:
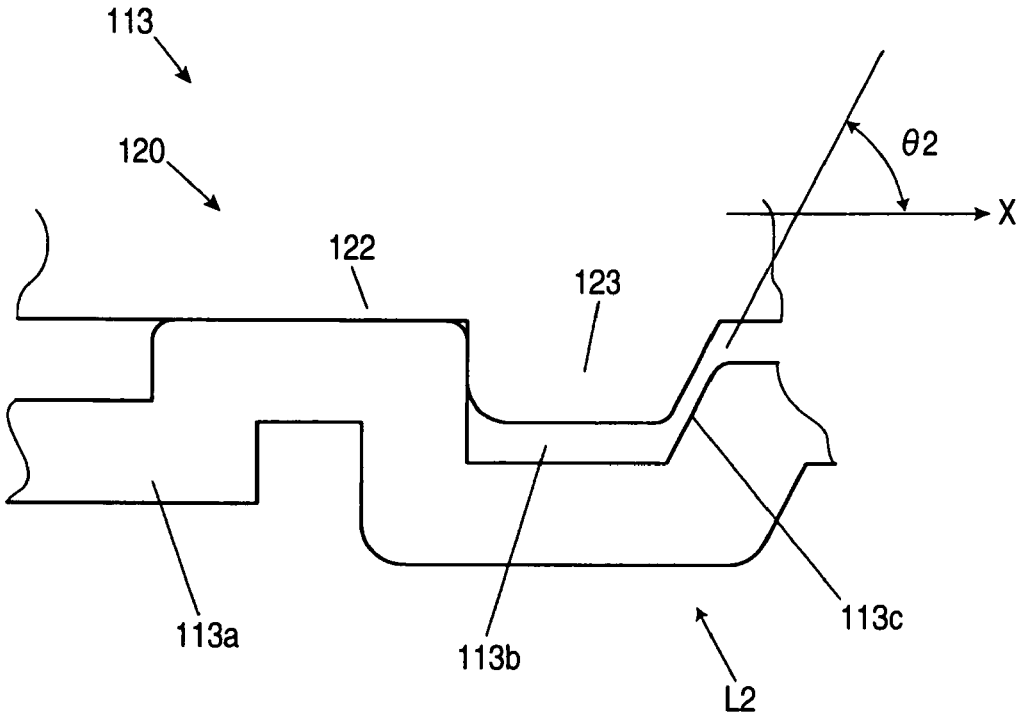
FIG. 12A is an enlarged view showing a locking mechanism in the upper, sheet feeding device.
Figure 12B:
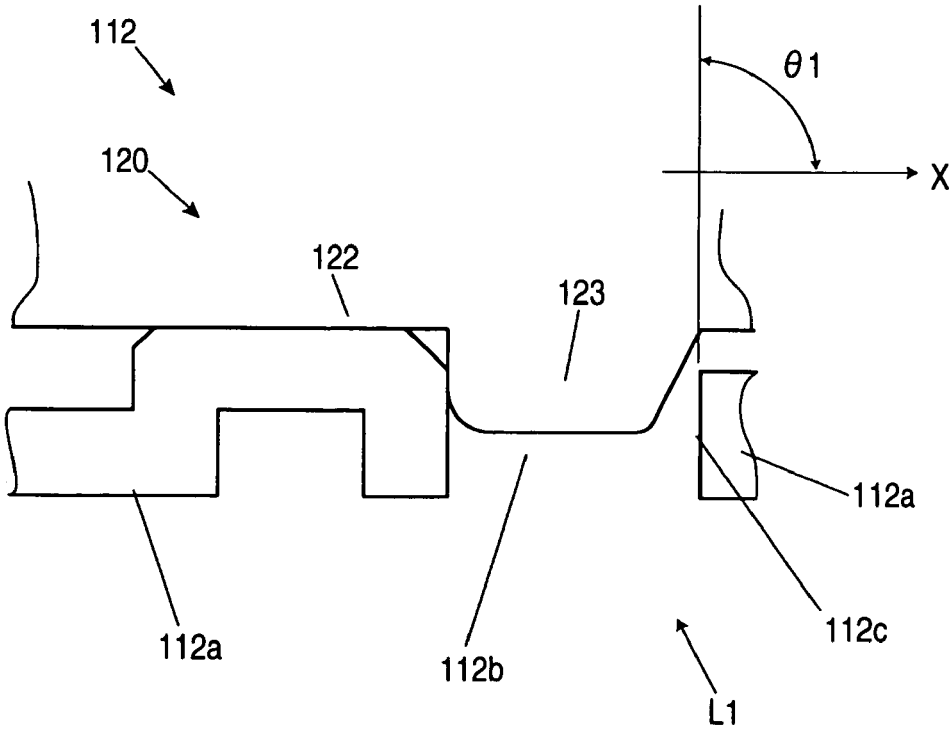
FIG. 12B is an enlarged view showing a locking mechanism in the lower sheet feeding device.

As shown in FIGS. 12A and 12B, in this embodiment, engagement angles (equivalent to engagement strengths) θ1 and θ2 between the recess and the protrusion described above that constitute the locking mechanisms L1 and L2 are set up such that the cassette body of upper stage should have a smaller value than the cassette body of lower stage.

More specifically, the angle θ2 between the engagement wall face 113*c* for the protrusion 123 of the cassette body 120 in the recess 113*b* of the cassette chamber 113 of upper stage and the direction X of withdrawal of the cassette body 120 is set smaller than the angle θ1 between the engagement wall face 112*c* for the protrusion 123 of the cassette body 120 in the recess 112*b* of the cassette chamber 112 of lower stage and the direction X of withdrawal of the cassette body 120.

In this embodiment, the cassette bodies 120 have the identical shape. That is, the protrusions 123 in the plural stages of cassette bodies 120 have the identical shape, while the recesses 112*b* and 113*b* in the casing body 111 have different shapes, so that the engagement angles or engagement strengths of the recesses and the protrusions between the casing body 111 and the cassette bodies 120 are set up such that the cassette body of upper stage should have a smaller value than the cassette body of lower stage.

Figure 11A:
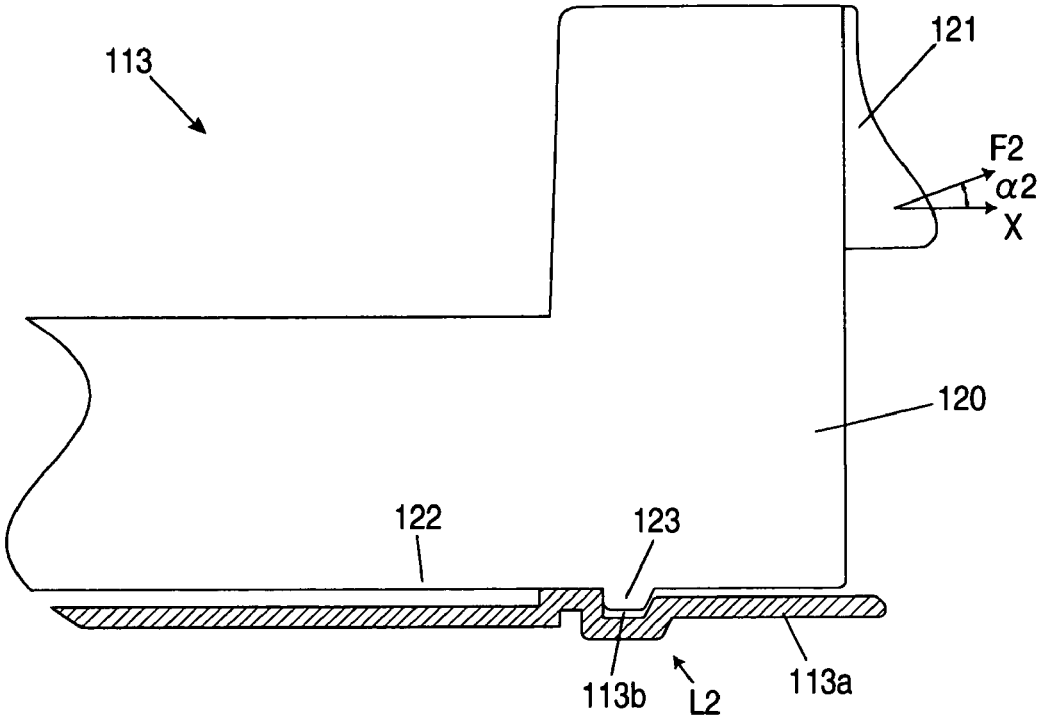
FIG. 11A is a section view of an upper sheet feeding device in the image forming apparatus of FIG. 10A.
Figure 11B:
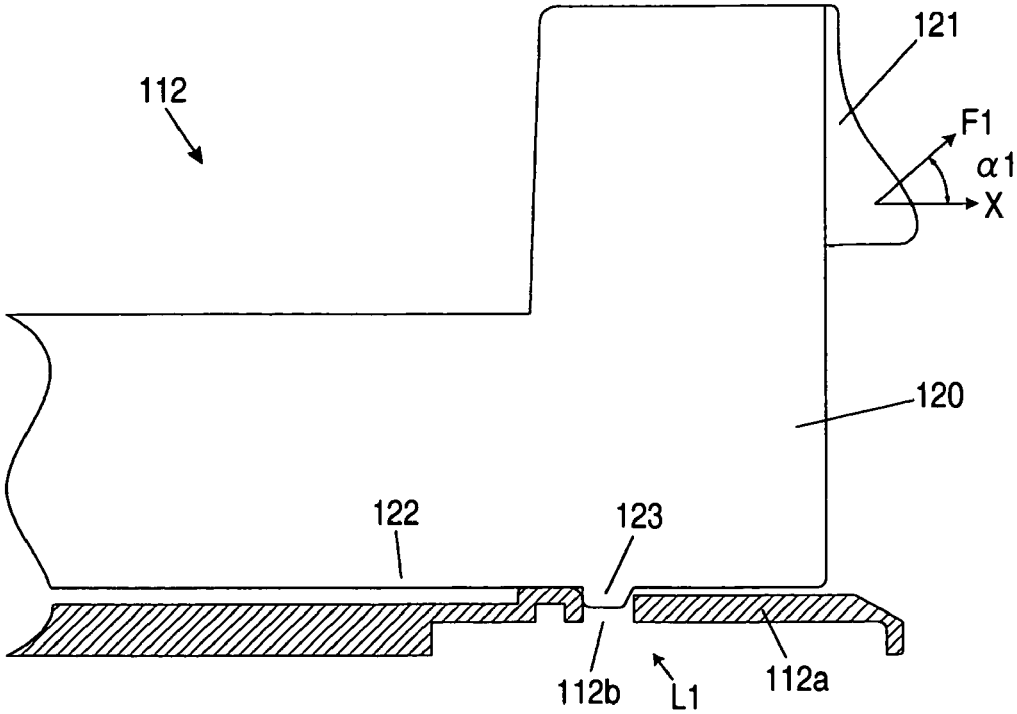
FIG. 11B is a section view of a lower sheet feeding device in the image forming apparatus of FIG. 10A.

In general, as shown in FIGS. 11A and 11B, as for the withdrawal angle at the time of withdrawing the cassette body 120, that is, the angle between the direction in which the cassette body 120 actually moves X (in general, approximately in the horizontal direction) and the direction in which the user applies a force of withdrawal, the withdrawal angle $\alpha 2$ for the cassette body of upper stage is smaller than the withdrawal angle $\alpha 1$ for the cassette body of lower stage.

If the engagement angles or engagement strengths of the recesses and protrusions were set to be the same for the cassette bodies of all stages, the engagement angle becomes smaller at the time of withdrawing the lower stage. Thus, the user feels lighter when withdrawing the cassette body of lower stage, and feels heavier when withdrawing the cassette body of upper stage.

In contrast, according to the above configurations, the withdrawal force F1 necessary when the user withdraws the cassette body of lower stage can be approximately the same as the withdrawal force F2 necessary when the user withdraws the cassette body of upper stage. Thus, a feeling that something wrong is avoided (at least reduced) when the user withdraws cassette bodies of different stages.

Further, since the protrusions 123 in the plural stages of cassette bodies 120 have the identical shape, while the recesses 112*b* and 113*b* in the casing body 111 have different shapes, so that the engagement angles or engagement strengths of the recesses and the protrusions between the casing body 111 and the cassette bodies 120 are set up such that the cassette body of upper stage should have a smaller value than the cassette body of lower stage. Thus, the above advantages can be obtained while the cassette bodies 120 are shared for all stages.

For example, recesses may be formed in the cassette bodies 120, while protrusions may be formed in the casing body 111. Also in this case, the same operation and effect are obtained. Further, when three or more stages of cassette bodies 120 are provided, the engagement angles described above are set up such that an upper stage should have a smaller value.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A sheet feeding device, comprising:

a cassette chamber, having a slot;

a cassette member, adapted to accommodate a sheet medium therein, and to be withdrawably inserted into the cassette chamber through the slot in a first direction;

a pair of claw members, provided in the cassette member and adapted to cover at least a part of a top face of the sheet medium;

a sheet feeding roller, adapted to feed the sheet medium to an image forming apparatus in a second direction perpendicular to the first direction, and disposed such that a part of the sheet feeding roller is capable of entering the cassette chamber; and slope faces, formed on both sides of the part of the sheet feeding roller relative to the first direction, and inclined in a third direction orthogonal to the first direction and the second direction, wherein one of the claw members which is located farther from the slot is formed with a piece member extending in the first direction while being inclined in the third direction.

2. The sheet feeding device as set forth in claim 1, wherein one of the claw members which is closer to the slot is formed with a piece member extending in a fourth direction opposite to the first direction while being inclined in the third direction.

3. A sheet feeding device, operable to feed a sheet medium to an image forming apparatus, comprising:

a cassette chamber, having an inner face;

a cassette member, adapted to accommodate the sheet medium therein, and to be withdrawably inserted into the cassette chamber in a first direction, the cassette member having an outer face adapted to oppose the inner face of the cassette chamber when the cassette member is inserted into the cassette chamber;

at least one recess, formed on one of the inner face of the cassette chamber and the outer face of the cassette member; and at least one protrusion, formed on the other one of the inner face of the cassette chamber and the outer face of the cassette member, and adapted to be fitted with the recess when the cassette member is plenarily inserted into the cassette chamber, wherein a plurality of recesses and protrusions are arrayed in a second direction perpendicular to the first direction.

4. The sheet feeding device as set forth in claim 3, wherein the sheet medium is fed in the second direction.

5. The sheet feeding device as set forth in claim 3, wherein:

the outer face of the cassette is a front face relative to the first direction, and the inner face of the cassette chamber is a face opposing the front face.

6. A sheet feeding device, adapted to feed a sheet medium to an image forming apparatus, comprising:

a first cassette chamber, formed with a first recess;

a second cassette chamber, located above the first cassette chamber, the second cassette chamber formed with a second recess;

a first cassette member, adapted to accommodate the sheet medium therein, and to be withdrawably inserted into the first cassette chamber in a first direction;

a second cassette member, adapted to accommodate the sheet medium therein, and to be withdrawably inserted into the second cassette chamber in the first direction;

a first protrusion, formed on the first cassette member and adapted to be engaged with the first recess with a first engagement strength, when the first cassette member is inserted into the first cassette chamber; and a second protrusion, formed on the second cassette member and adapted to be engaged with the second recess with a second engagement strength which is smaller than the first engagement strength, when the second cassette member is inserted into the second cassette chamber.

7. The sheet feeding device as set forth in claim 6, wherein:

the first protrusion and the second protrusion have an identical shape including a first face;

the first recess has a second face adapted to oppose the first face of the first protrusion in the first direction and inclined with a first angle relative to the first direction; and the second recess has a third face adapted to oppose the first face of the second protrusion in the first direction and inclined with a second angle which is smaller than the first angle relative to the first direction.

* * * * *